US010441843B2

(12) United States Patent
Ho et al.

(10) Patent No.: US 10,441,843 B2
(45) Date of Patent: Oct. 15, 2019

(54) STEPPER EXERCISE MACHINE WITH ADJUSTABLE RESISTANCE

(71) Applicants: Wei-Teh Ho, Taipei (TW); Willy Wei Yu Ho, Taipei (TW)

(72) Inventors: Wei-Teh Ho, Taipei (TW); Willy Wei Yu Ho, Taipei (TW)

( * ) Notice: Subject to any disclaimer, the term of this patent is extended or adjusted under 35 U.S.C. 154(b) by 81 days.

(21) Appl. No.: 15/716,423

(22) Filed: Sep. 26, 2017

(65) Prior Publication Data

US 2018/0015321 A1 Jan. 18, 2018

Related U.S. Application Data

(63) Continuation-in-part of application No. 15/218,623, filed on Jul. 25, 2016, now abandoned, which is a continuation-in-part of application No. 29/543,858, filed on Oct. 28, 2015, now Pat. No. Des. 796,591, and a continuation-in-part of application No. 29/569,254, filed on Jun. 24, 2016, now Pat. No. Des. 827,732.

(51) Int. Cl.

| | |
|---|---|
| ***A63B 22/00*** | (2006.01) |
| ***A63B 21/00*** | (2006.01) |
| ***A63B 21/008*** | (2006.01) |
| ***A63B 22/06*** | (2006.01) |
| *A63B 71/06* | (2006.01) |

(52) U.S. Cl.

CPC ..... *A63B 22/0056* (2013.01); *A63B 21/008* (2013.01); *A63B 21/00058* (2013.01); *A63B 21/00069* (2013.01); *A63B 22/0664* (2013.01); *A63B 71/0622* (2013.01); *A63B 2022/0688* (2013.01); *A63B 2208/0204* (2013.01); *A63B 2208/0233* (2013.01); *A63B 2220/17* (2013.01); *A63B 2225/09* (2013.01); *A63B 2225/093* (2013.01); *A63B 2225/68* (2013.01); *A63B 2230/75* (2013.01)

(58) Field of Classification Search

None

See application file for complete search history.

(56) References Cited

U.S. PATENT DOCUMENTS 3,316,898 A * 5/1967 Brown ..... A63B 21/00178 482/51

4,159,111 A 6/1979 Lowth (Continued)

*Primary Examiner* — Stephen R Crow

(74) *Attorney, Agent, or Firm* — Womble Bond Dickinson (US) LLP

(57) ABSTRACT

A stepper exercise device includes a base support frame, a wheel assembly having a first wheel, a stepper assembly coupled to the base support base and first wheel of the wheel assembly, and a resistance adjustment mechanism coupled to the wheel assembly. The stepper assembly includes a first step pedal and a second step pedal coupled to a first side and a second side of the first wheel respectively. The first step pedal and the second step pedal are configured to move in an elliptical motion resembling a step motion of a user as if the user walked on the support surface. The resistance adjustment mechanism is configured to provide different amounts of resistance to rotational motions of the first wheel, which in turn provides various resistance to step motions of the first and second step pedals to adjust the intensity of the exercise.

12 Claims, 17 Drawing Sheets

(56) References Cited

U.S. PATENT DOCUMENTS 4,688,790 A * 8/1987 Hokajarvi ..... A63B 21/015 482/63
5,199,931 A * 4/1993 Easley ..... A63B 21/015 482/110
5,290,204 A 3/1994 Lee
5,348,520 A 9/1994 Chang
5,647,826 A 7/1997 Butler
5,823,919 A 10/1998 Eschenbach
5,916,065 A 6/1999 McBride
5,928,114 A 7/1999 Chen
6,004,244 A * 12/1999 Simonson ..... A63B 21/153 482/51
6,159,132 A 12/2000 Chang
6,224,515 B1 5/2001 Chen
6,315,697 B1 11/2001 Chen
6,435,073 B1 8/2002 Chen
D465,001 S 10/2002 Chiang-Chow
D466,567 S 12/2002 Chen
6,698,431 B1 3/2004 Harris
6,709,367 B1 3/2004 Liang
D496,700 S 9/2004 Chen
D498,506 S 11/2004 Yu
6,830,539 B2 12/2004 Chuang
6,918,857 B2 7/2005 Chen
D514,635 S 2/2006 Hsiao
D519,583 S 4/2006 Chen
7,384,378 B2 7/2008 Chen
7,462,136 B2 12/2008 Pan
7,462,137 B2 12/2008 Yang
7,465,255 B2 12/2008 Chen
7,530,927 B2 5/2009 Chuang
7,637,849 B2 12/2009 Chen
7,869,780 B2 1/2011 Chen
7,878,948 B2 2/2011 Chen
7,878,949 B2 2/2011 Chen
7,892,148 B1 2/2011 Stauffer
7,951,048 B1 5/2011 Hsiung
8,152,698 B1 4/2012 Chen
8,485,945 B2 7/2013 Leonhard
D728,707 S 5/2015 Colburn
9,474,925 B1 10/2016 Hsiung
9,713,739 B2 * 7/2017 Dalmia ..... A63B 21/225
10,080,918 B2 * 9/2018 Dalmia ..... A63B 21/225
2003/0017916 A1 1/2003 Juan
2003/0216224 A1 11/2003 Chuang
2005/0049116 A1 3/2005 Huang
2005/0064998 A1 3/2005 Hill
2005/0070403 A1 3/2005 Yu
2005/0170934 A1 8/2005 Myles
2005/0227918 A1 10/2005 Liao
2006/0009330 A1 * 1/2006 Lo ..... A63B 21/00181 482/52
2007/0202996 A1 8/2007 Lu
2007/0254782 A1 11/2007 Chen
2008/0020904 A1 1/2008 Ho
2008/0026916 A1 1/2008 Chuang
2008/0254948 A1 10/2008 Chen
2009/0239714 A1 9/2009 Sellers
2010/0144495 A1 6/2010 Chen
2010/0267519 A1 10/2010 Johnson, II
2013/0316879 A1 11/2013 Prats
2014/0080676 A1 3/2014 Wang
2014/0274574 A1 9/2014 Shorten
2015/0375030 A1 * 12/2015 Yang ..... A63B 21/015 482/52
2016/0082311 A1 3/2016 Massaro

* cited by examiner

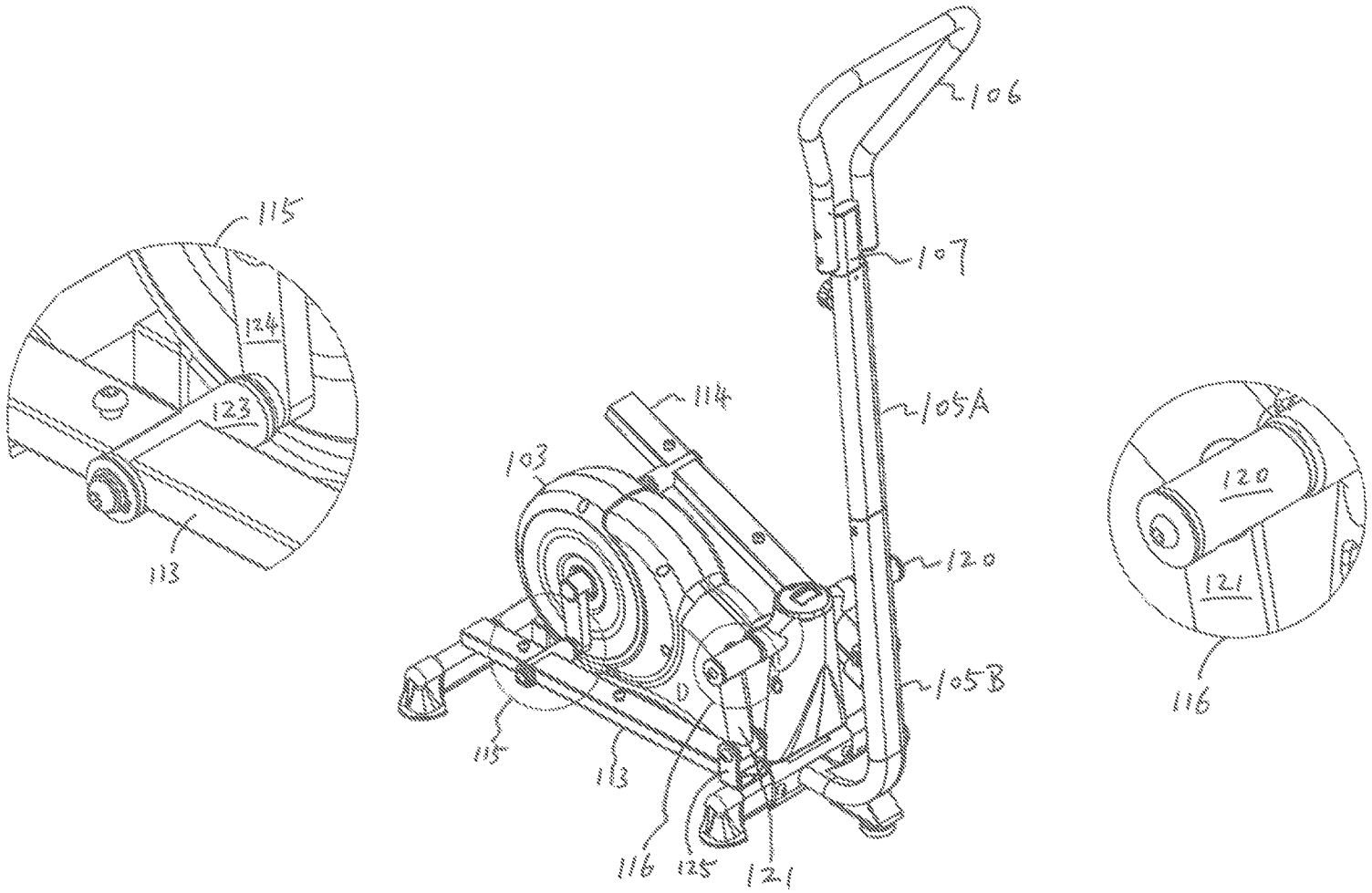
115
113
121
123
113
113
113
113
113
121
123
115
113
113
113
113
113

STEPPER EXERCISE MACHINE WITH ADJUSTABLE RESISTANCE

RELATED APPLICATIONS

This application is a continuation-in-part (CIP) of co-pending U.S. patent application Ser. No. 15/218,623 filed Jul. 25, 2016, which is a CIP of U.S. design patent application Ser. No. 29/543,858 filed Oct. 28, 2015, now U.S. Pat. No. D796,591, and U.S. design patent application Ser. No. 29/569,254 filed Jun. 24, 2016. The disclosure of the above applications is incorporated by reference in its entirety.

FIELD OF THE INVENTION

Embodiments of the present invention relate generally to physical training machines, and in particular, to exercise machines commonly referred to a stepper exercise machine with adjustable resistance.

BACKGROUND

As people eat better and work longer, mostly sitting in an office, they wish to use exercise machines more frequently. As a result, many families prefer to purchase one to use at home. However, exercise machines generally available in the market either consume too much space at home or are expensive. They are usually limited to one function and thus cannot meet the varying needs of a particular user or the requirements from different people at the same time.

Exercise machines having alternating reciprocating pedals are configured to travel about a closed, elliptical path to simulate a stride, running, walking, and/or a climbing motion, and are commonly referred to as elliptical exercise machines. Currently, no such elliptical exercise machines are available to meet the various requirements as mentioned above. Therefore, traditional elliptical exercise machines require an improved design to accommodate different user requirements and/or reduce the cost and space needed.

BRIEF DESCRIPTION OF THE DRAWINGS

Embodiments of the invention are illustrated by way of example and not limitation in the figures of the accompanying drawings in which like references indicate similar elements.

FIGS. 2A-2C show a perspective view of a stepper exercise device according to another embodiment.

DETAILED DESCRIPTION

Figure 1:
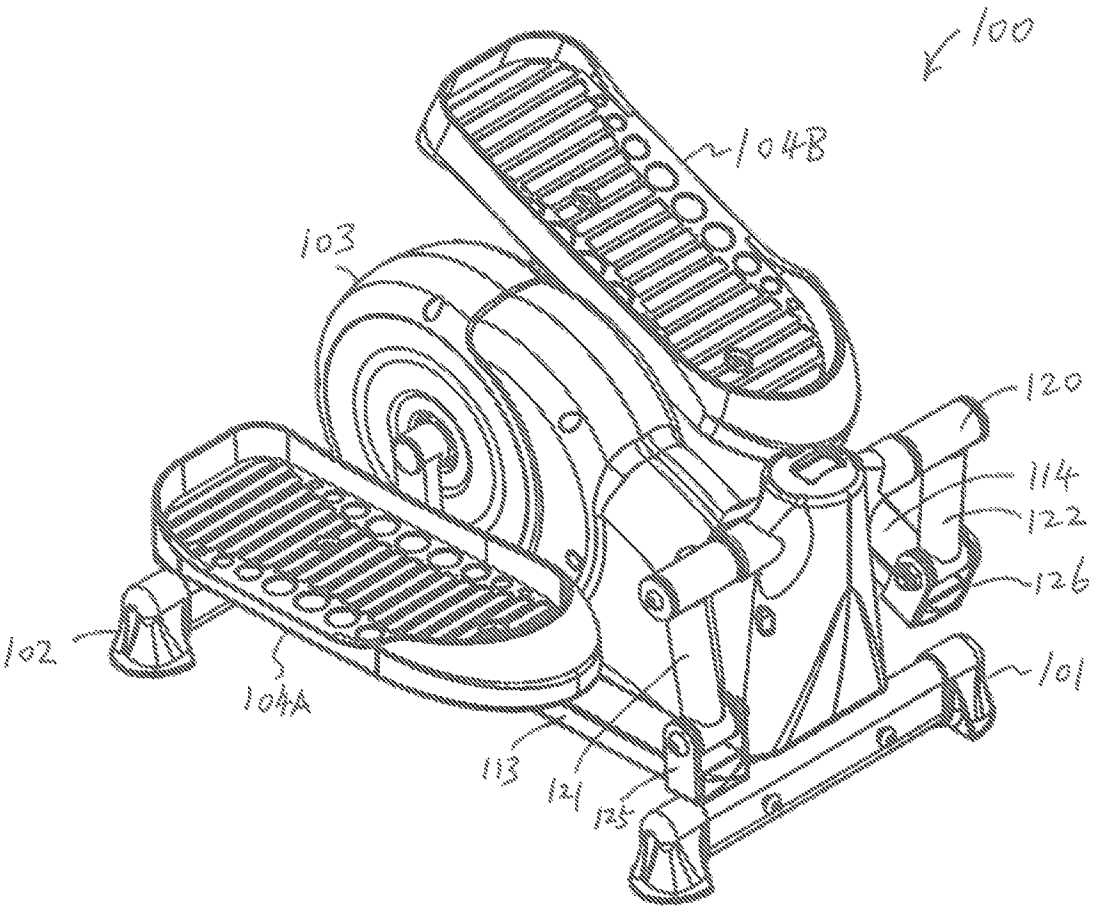
FIG. 1 shows a perspective view of a stepper exercise device according to one embodiment.

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Reference in the specification to "one embodiment" or "an embodiment" means that a particular feature, structure, or characteristic described in conjunction with the embodiment can be included in at least one embodiment of the invention. The appearances of the phrase "in one embodiment" in various places in the specification do not necessarily all refer to the same embodiment.

According to some embodiments, a stepper exercise device includes a base support frame adapted to be positioned on a support surface, a wheel assembly mounted on the base support frame where the wheel assembly includes a first wheel being capable of being rotated, a stepper assembly coupled to the base support base and first wheel of the wheel assembly, and a resistance adjustment mechanism coupled to the wheel assembly. The stepper assembly includes a first step pedal and a second step pedal coupled to a first side and a second side of the first wheel respectively. The first step pedal and the second step pedal are configured to move in an elliptical motion resembling a step motion of a user as if the user walked on the support surface. The resistance adjustment mechanism is configured to provide different amounts of resistance to rotational motions of the first wheel, which in turn provides various amounts of resistance to step motions of the first step pedal and the second step pedal to adjust the intensity of the exercise of the user.

According to one embodiment, the wheel assembly further includes a second wheel coupled to the first wheel. The second wheel operates as a resistant load to the first wheel. The resistance adjustment mechanism is configured to adjust a resistance of the second wheel, which in turn adjusts the resistance of the first wheel. In one embodiment, the first wheel and the second wheel are coupled to each other via a transmission belt. In one embodiment, the resistance adjust mechanism further includes a braking device or brake device to provide different amounts of frictions to an exterior surface of the second wheel. The braking device includes a brake pad capable of being applied to the exterior surface of the second wheel. The resistance adjustment mechanism is configured to apply various pressure to the brake pad, which in turn transforms various resistance to the second wheel.

According to another embodiment, the resistance adjustment mechanism further includes a rotational knob mounted on the base support base and a brake line coupled to the rotational knob and the braking device. When the rotational knob rotates, the brake line is pulled to cause the braking device to push the brake pad against the exterior surface of the second wheel, which in turn increases the friction between the brake pad and the exterior surface of the second wheel. The brake line further includes a tubing device enclosing a wire or string therein. The tubing device may be flexible laterally but is non-compressible longitudinally. The tubing device includes a first end coupled to the rotational knob and a second end coupled to the braking device. When the rotational knob rotates in a first direction (e.g., clockwise), the wire is pulled within the tubing device, which in turn causes the brake pad being pressed against the exterior surface of the second wheel. When the rotational knob rotates in a second direction (e.g., counter clockwise), the wire is retracted into the tubing device, which in turn releases the brake pad from against the exterior surface of the second wheel.

According to one embodiment, the braking device includes a brake holding plate to hold the brake pad. The brake holding plate includes a first section and second section jointed together in an angle to form a joint section (e.g., an L-shape plate). The brake pad is disposed on a far end of the first section and the wire is coupled to a far end of the second section. A far end refers to an end that is away from the joint section, i.e., the ends of the L-shape plate. The braking device further includes a support rod to provide a support to the joint section of the brake holding plate to allow the brake holding plate to tilt forwardly and backwardly with respect to the support rod. When the wire is pulled towards the rotational knob, the far end of the second section is pulled to cause the far end of the first section to be tilted with respect to the support rod, which in turn pushes the brake pad against the exterior surface of the second wheel.

FIG. 1 shows a perspective view of a stepper exercise device according to one embodiment. Referring to FIG. 1, stepper exercise device 100 includes a base support frame having a front portion 101 and a rear portion 102, a wheel assembly 103 mounted on the base support frame, and a stepper assembly having a step pedal 104A and a step pedal 104B disposed on each side of wheel assembly 103. The wheel assembly 103 includes a first wheel enclosed therein. Step pedal 104B is mounted on a step support plate 114 and step pedal 104A is mounted on a step support plate 115, for example, using a screw. Each of the step support plates 114-115 is coupled to the first wheel and the base support frame. For example, as shown in FIG. 1, the frontend of step support plate 113 is coupled to a lower end of a hanging bar 121 via a hinge, where a top or upper end of the hanging bar 121 is coupled to one end of top bar 120 disposed horizontally on the base support frame. Similarly, the frontend of step support plate 114 is coupled to a lower end of hanging bar 122 via a hinge, where the top or upper end of hanging bar 122 is coupled to the other end of top bar 120.

Figure 2A:
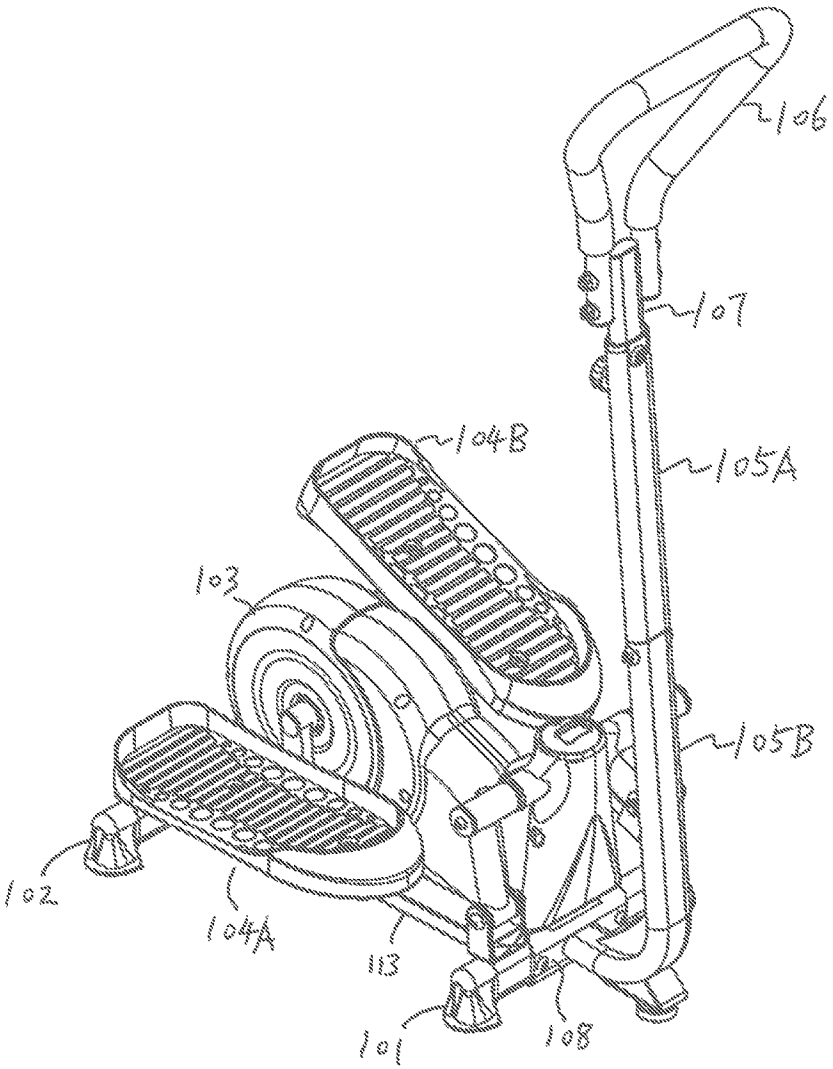
Figure 2B:
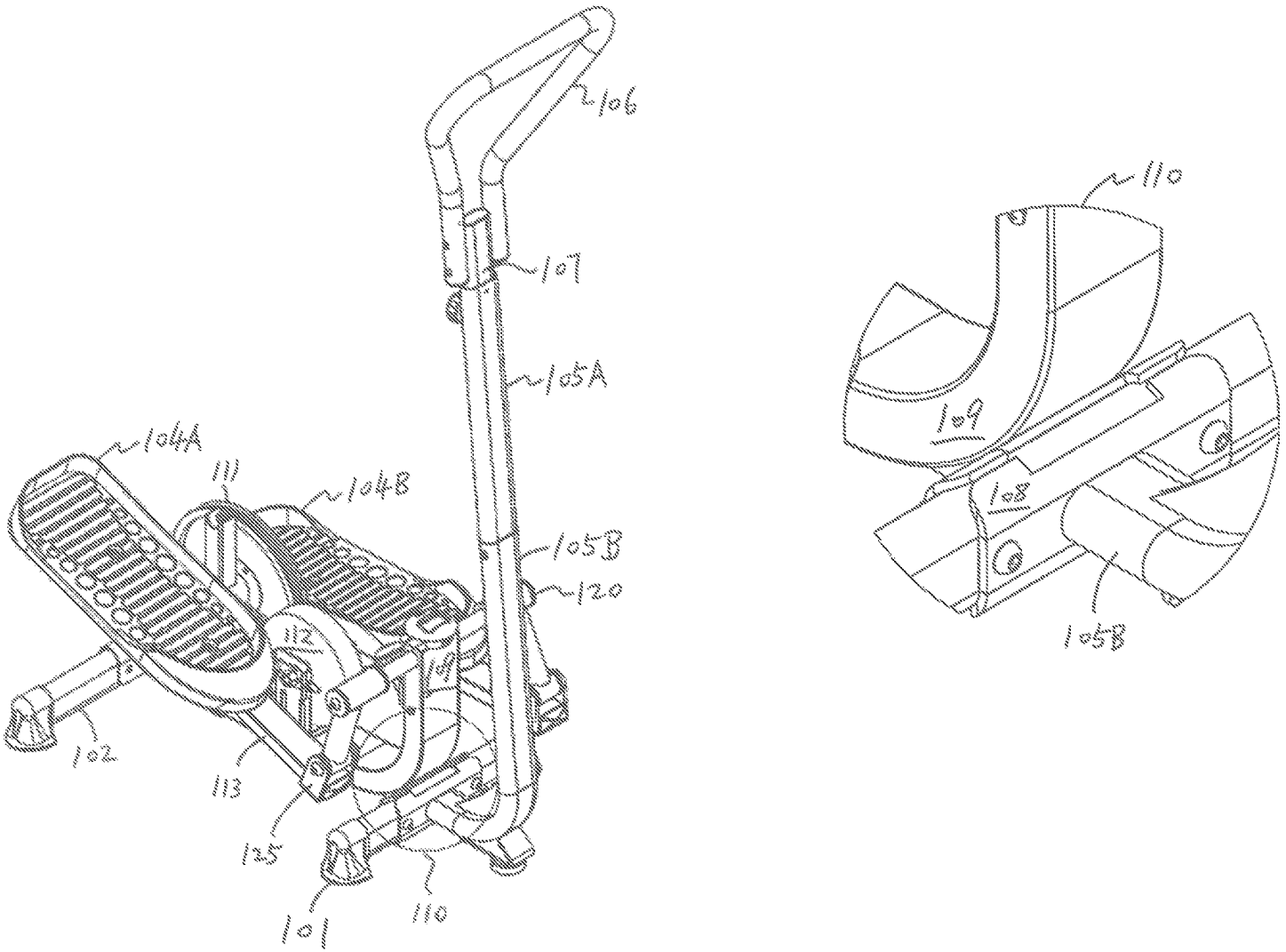

Referring now to FIGS. 2A and 2B, a main post or main beam having an upper section 105A and a lower section 105B can be attached to the frontend of the base support frame, in this example, using a mounting bracket 108, which can be mounted onto frontend bar 101 using screws. In this example, the main post is an L-shape post extended up front and upwardly. An extendable section 107 is coupled to the upper section 105A. In one embodiment, at least upper section 105A is in a tubular shape to allow the extendable section 107 to be extended or retracted into the internal space of upper section 105A at different lengths. Handle bar 106 is attached to an upper end of extendable section 107. The handle bar 106 is configured in an inversed triangular shape to allow a user to grab and hold onto it during the elliptical stepping motions. Sections 105A-105B and 106-107 can be disconnected from the main body as shown in FIG. 1 for storage purpose.

FIG. 2B shows an open view of FIG. 2A by removing a cover of wheel assembly 103. As shown in FIG. 2B, wheel assembly 103 includes a first wheel 111 and a second wheel 112. The base support frame includes a frontend beam 101, a backend beam 103, and a center support base 109. In one embodiment, frontend beam 101 and backend beam 102 are substantially parallel to each other, while center support base 109 is coupled to frontend beam 101 and backend beam 102 perpendicularly, for example, forming an H shape. In one embodiment, center support base 109 is configured in an L shape having two sections. The first section of the L-shape support base is positioned horizontally, while the second section is positioned vertically. Wheel assembly 103 is mounted on the horizontal section of center support base 109. Top bar 120 is disposed on the top of the vertical section of center support base 109.

FIG. 2C shows another perspective view of the stepper exercise device according to another embodiment. Referring to FIG. 2C, in this embodiment, step pedals 104-105 have been removed to show details of step support plates 113-114. Although step support plate 114 is not shown, the structures of both step support plates 113-114 are substantially identical and their motions are also similar. In one embodiment, the frontend of step support plate 113 is coupled to hanging bar 121 via a hinge, while hanging bar 121 is rotatably hang off top bar 120. The backend of step support plate 113 is fixed coupled to a connection bar 123. The connection bar 123 rotatably encloses an internal bar or internal rod (not shown), while the internal bar is fixed to a far end of hanging bar 124, as shown in the enlarged portion 115. Thus, connection bar 123 can rotate relative to the internal bar. A near end of hanging bar 124 is fixed coupled to an axle of the first wheel. Thus, the backend of step support plate or support beam 113 and connection bar 123 can circularly rotate along the perimeter of the first wheel by following the far end of hanging bar 124.

The frontend of step support plate 113 is coupled to a U-shape bracket 125, which in turn is coupled to a lower end of hanging bar 121 via a hinge. Similarly, step support plate 114 is coupled to a U-shape bracket 126, which in turn is coupled to a lower end of hanging bar 122. The upper end of hanging bar 121 is rotatably coupled to top bar 120, which allows hanging bar 121 to swing relative to top bar 120. Specifically, the upper end of hanging bar 121 is fixedly coupled to an external tubular bar, where external tubular bar rotatably encloses an internal bar that is fixedly coupled to the base support frame as a part of top bar 120 as shown in the enlarged portion 116. Thus, the frontend of step support plate 113 can move forwardly and backwardly in a relatively horizontal direction due to the swing actions of hanging bar 121 relative to top bar 120. As a result, step pedal 104A, when mounted onto step support plate 113 using a pair of screws, can perform the elliptical motions relative to the support surface.

Figure 3:
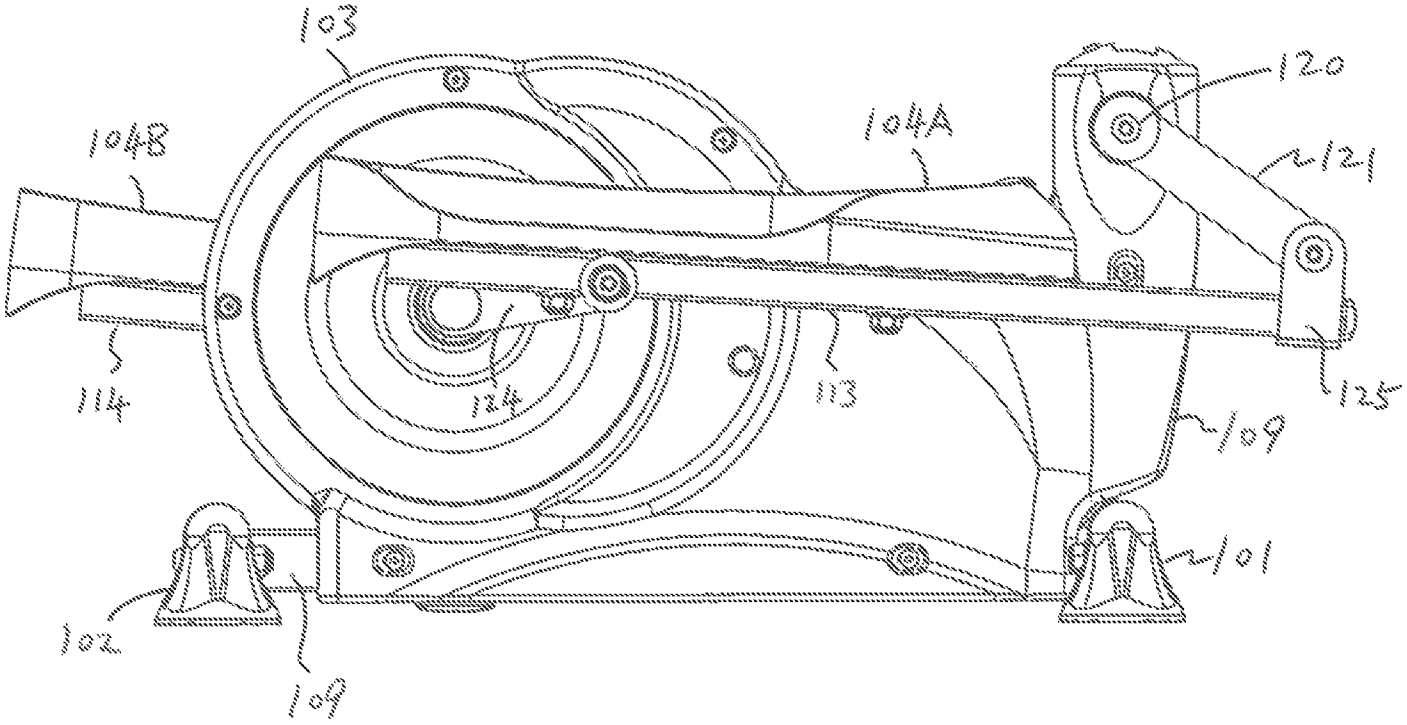
FIG. 3 shows a side view of a stepper exercise device according to one embodiment.
Figure 4A:
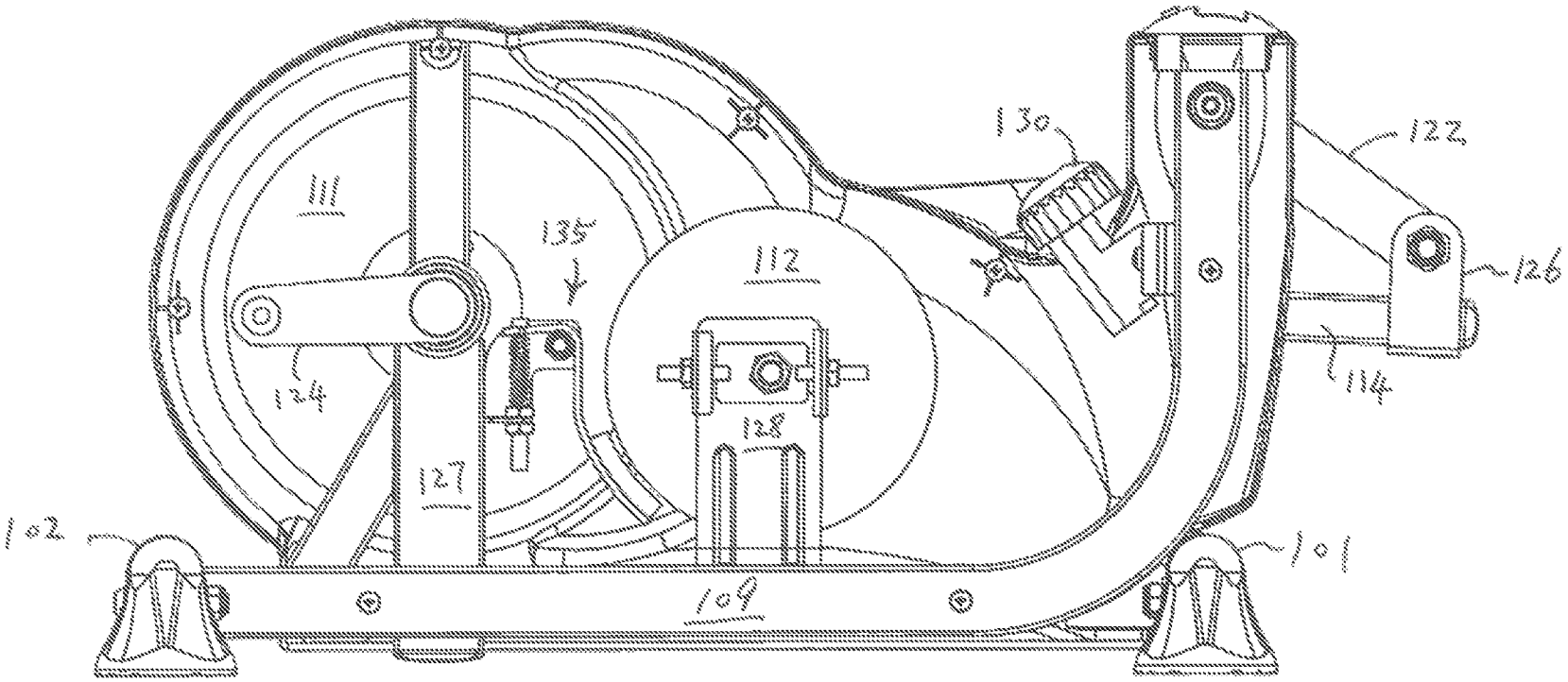
FIGS. 4A-4C show a side view of a stepper exercise device according to another embodiment.
Figure 4B:
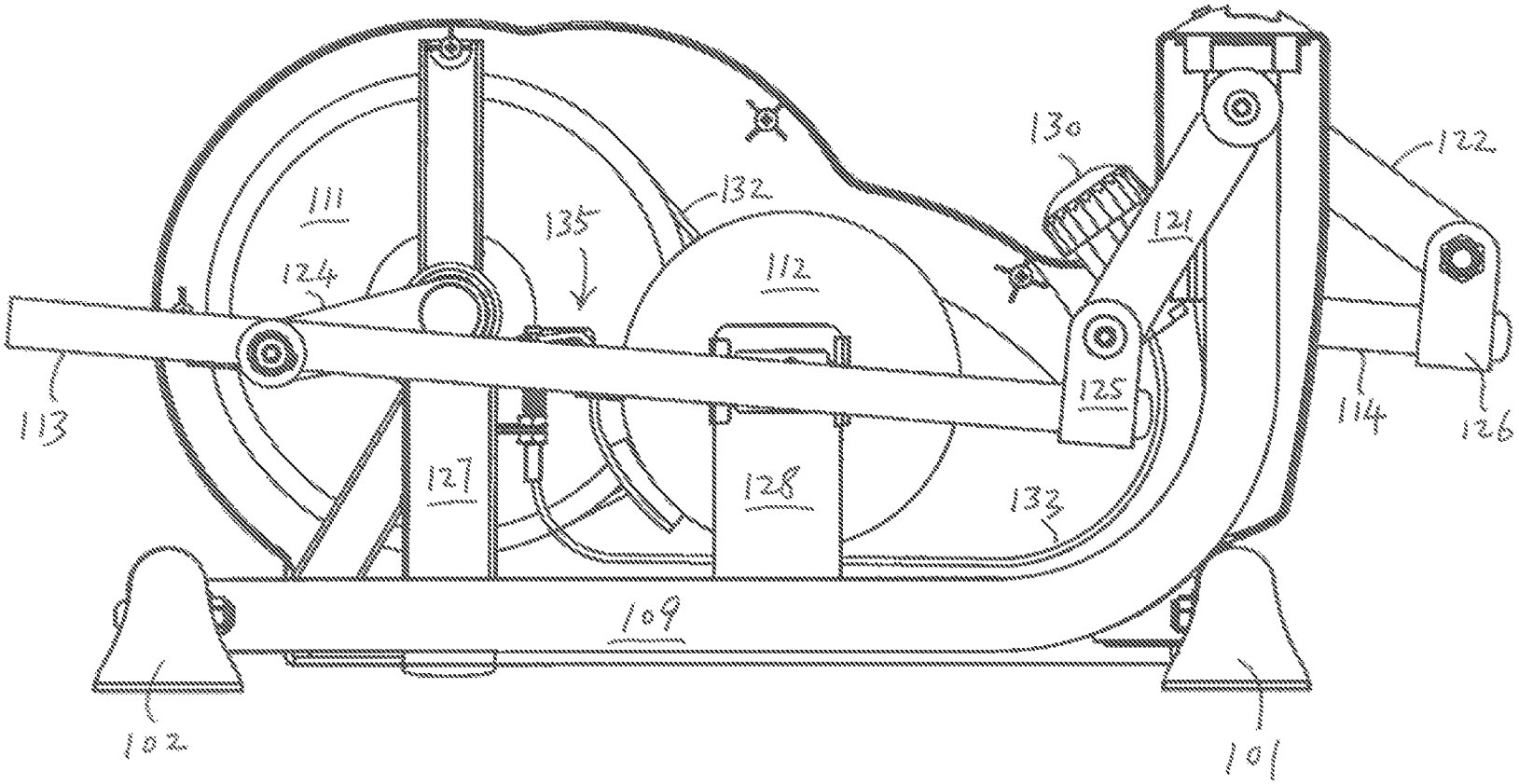
Figure 4C:
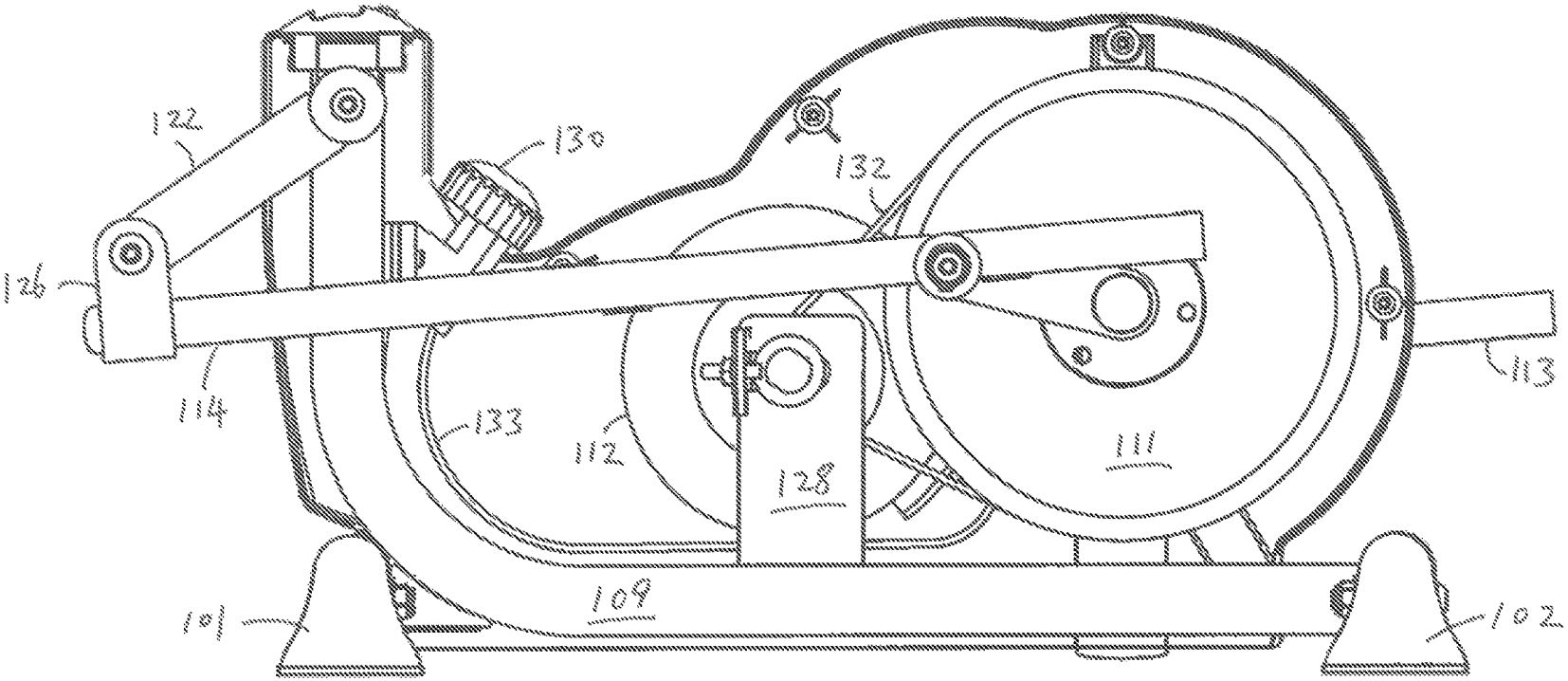

FIG. 3 shows a side view of a stepper exercise device according to one embodiment of the invention. FIGS. 4A-4C show an internal structure of FIG. 3. Referring to FIGS. 4A-4C, as described above, wheel assembly 103 includes first wheel 111 and second wheel 112. First wheel 111 is supported by a first wheel support beam 127 such as a U-shape structure. Specifically, a lower end of wheel support beam 127 (e.g., the bottom or closed end of the U-shape structure) is fixedly coupled to center support base 109 and an upper end of wheel support beam 127 (e.g., open ends of the U-shape structure) is coupled to the axle of first wheel 111, such that first wheel 111 can rotate relative to wheel support beam 127. Similarly, second wheel 112 is supported by second wheel support beam 128 such as a U-shape structure. The lower end of support beam 128 (e.g., the bottom or closed end of the U-shape structure) is fixedly attached to center support base 109 and the upper end of support beam 128 (e.g., open ends of the U-shape structure) is coupled to the axle of the second wheel 112, such that the second wheel 112 can rotate relative to the support beam 128.

In addition, according to one embodiment, first wheel 111 is coupled to second wheel 112 via a transmission belt 132. Alternatively, wheels 111 and 112 can be coupled to each other via a gear coupling mechanism. Second wheel 112 operates as a workload with respect to first wheel 111, where second wheel 112 provides resistance to the rotational movement of first wheel 111. In one embodiment, the exercise device further includes a resistance adjustment mechanism to adjust the amount of resistance to second wheel 112, which in turn adjusts the resistance to the first wheel 111. The resistance adjustment mechanism at least includes a rotational knob 130 and a braking device 135, where the rotational knob 130 is coupled to the braking device 135 via a brake line 133. When rotational knob 130 rotates, it adjust the position of the braking device 135 with respect to second wheel 112 to provide different amount of braking friction to the movement of second wheel 112. Note that rotational knob 130 is utilized as an example of a brake control device to control braking device 135, for example, to press or release braking device 135 to move towards or move away from second wheel 112. Other types of brake control devices can also be applicable.

In one embodiment, when rotational knob 130 rotates in a first direction (e.g., clockwise), it causes via brake line 133 the braking device 135 to move against an exterior surface of wheel 112, which in turn increases an amount of friction between the braking device 135 and the exterior surface of wheel 112. In response, the resistance of wheel 112 is increased, which in turn increases the resistance of wheel 111. As a result, the intensity of the overall exercise can be increased. When rotational knob rotates in a second direction (e.g., counter clockwise), it causes via brake line 133 the braking device 135 to move away from the exterior surface of wheel 112, which in turn reduces the amount of friction between braking device 135 and the exterior surface of wheel 112.

Figure 5A:
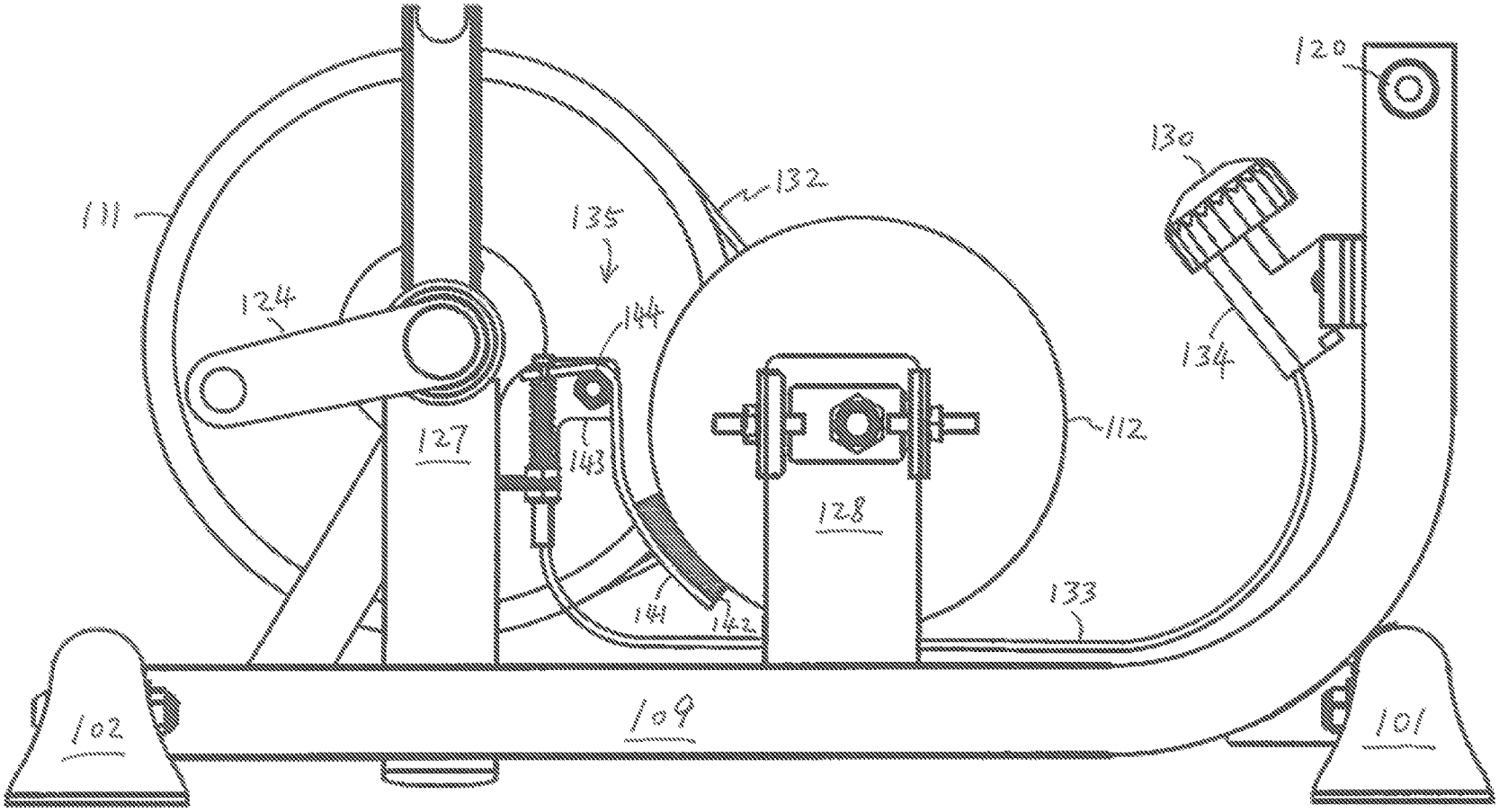
FIGS. 5A-5B show a resistance adjustment mechanism of a step exercise device according to one embodiment.
Figure 5B:
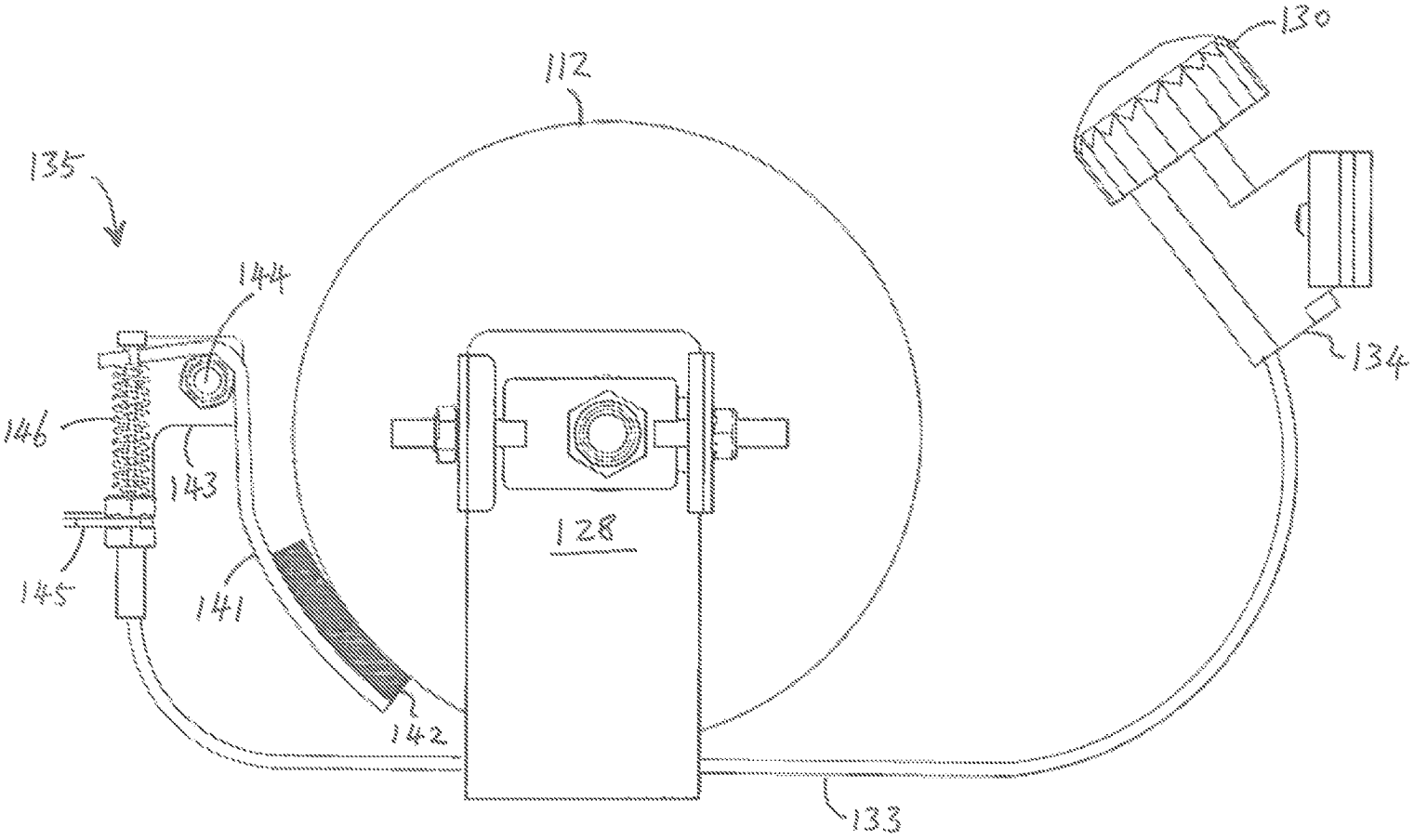

FIGS. 5A-5B show a resistance adjustment mechanism according to one embodiment of the invention. Referring to FIGS. 5A-5B, the exercise device includes a knob mounting bracket 134 attached to center support base 109, where rotational knob 130 is mounted on the mounting bracket 134. In this example, knob mounting bracket 134 is attached to a vertical section of the L-shape center support base 109. In one embodiment, braking device 135 includes a brake holding plate or brake holder 141 and a brake pad 142. Brake holding plate 141 includes a first section and a second section jointed together in an angle to form a joint section. In this embodiment, the first section and the second section forms a relatively L-shape device. The jointed section hangs onto a support rod 144, which is mounted on a brake mounting bracket 143, such that the brake holding plate 141 can tilt with respect to support rod 144 back and forth. The brake mounting bracket 143 is mounted on wheel support beam 127 of first wheel 111.

In one embodiment, brake pad 142 is attached to a far end of the first section of brake holding plate 141, while one end of brake line 133 is coupled to a far end of the second section of brake holding plate 141. The other end of brake line 133 is coupled to rotational knob 130. When rotational knob 130 rotates in a first direction (e.g., clockwise), it causes via brake line 133 the brake holding plate 141 to tilt in a first direction with respect to support rod 144, which in turn causes brake pad 142 to move towards the exterior surface of wheel 112. As a result, the friction between brake pad 142 and the exterior surface of wheel 112 increases, which in turn increases the resistance to the first wheel 111. When rotational knob 130 rotates in a second direction (e.g., counter clockwise), it causes via brake line 133 the brake holding plate 141 to tilt in a second direction with respect to support rod 144, which in turn causes brake pad 142 to move away from the exterior surface of wheel 112. As a result, the amount of friction between brake pad 142 and the exterior surface of wheel 112 is reduced, which in turn reduces the resistance to the first wheel 111.

Specifically, in one embodiment, when rotational knob 130 rotates in a first direction, it causes the brake line 133 to pull the far end of the second section of brake holding plate 141 downwardly, which in turn tilts the far end of the first section of brake holding plate 141 upwardly and brake pad attached thereon to move towards the exterior surface of wheel 112. Such a movement in turn increases the friction between the rake pad 142 and wheel 112. When rotational knob 130 rotates in a second direction, it causes the brake line 133 to move the far end of the second section of brake holding plate 141 upwardly, which in turn tilts the far end of the first section of brake holding plate 141 downwardly and brake pad 142 to move away from the exterior surface of wheel 112. Such a movement in turn reduces the friction between the brake pad 142 and wheel 112.

According to one embodiment, brake line 133 includes a tubing device and a wire or string enclosed therein, where the wire can freely move back and forth within the tubing device. In one embodiment, the tubing device is a flexible tube that is flexible laterally, but cannot be stretched or compressed longitudinally. In addition, brake mounting bracket 143 further includes a stop plate 145 having a hole with opening facing vertically. The hole is large enough to allow the wire to go through to connect with the far end of the second section of brake holding plate 141, while the hole is smaller enough to prevent the tubing device from going through. As a result, when rotational knob 130 rotates, the wire can be pulled and pushed within the tubing device, while the tubing device remains steady.

In one embodiment, the braking device 135 further includes a spring enclosing or surrounding a section of the wire between stop plate 145 and the far end of the second section of brake holding plate 141. When rotational knob 130 rotates in a first direction, it pulls the wire towards knob mounding bracket 134, which in turn pulls down the far end of the second section of brake holding plate 141. As a result, the far end of the first section of brake holding plate 141 and brake pad 142 are tilted towards wheel 112 and spring 146 to be compressed. When rotational knob 130 rotates in a second direction, it releases the wire towards braking device 135. Such an action causes spring 136 to expand or decompress back to its neutral position, which in turn causes the far end of the second section of brake holding plate 141 to move upwardly. As a result, the far end of the first section of brake holding plate 141 and brake pad 142 are tilted away from wheel 112.

Figure 6:
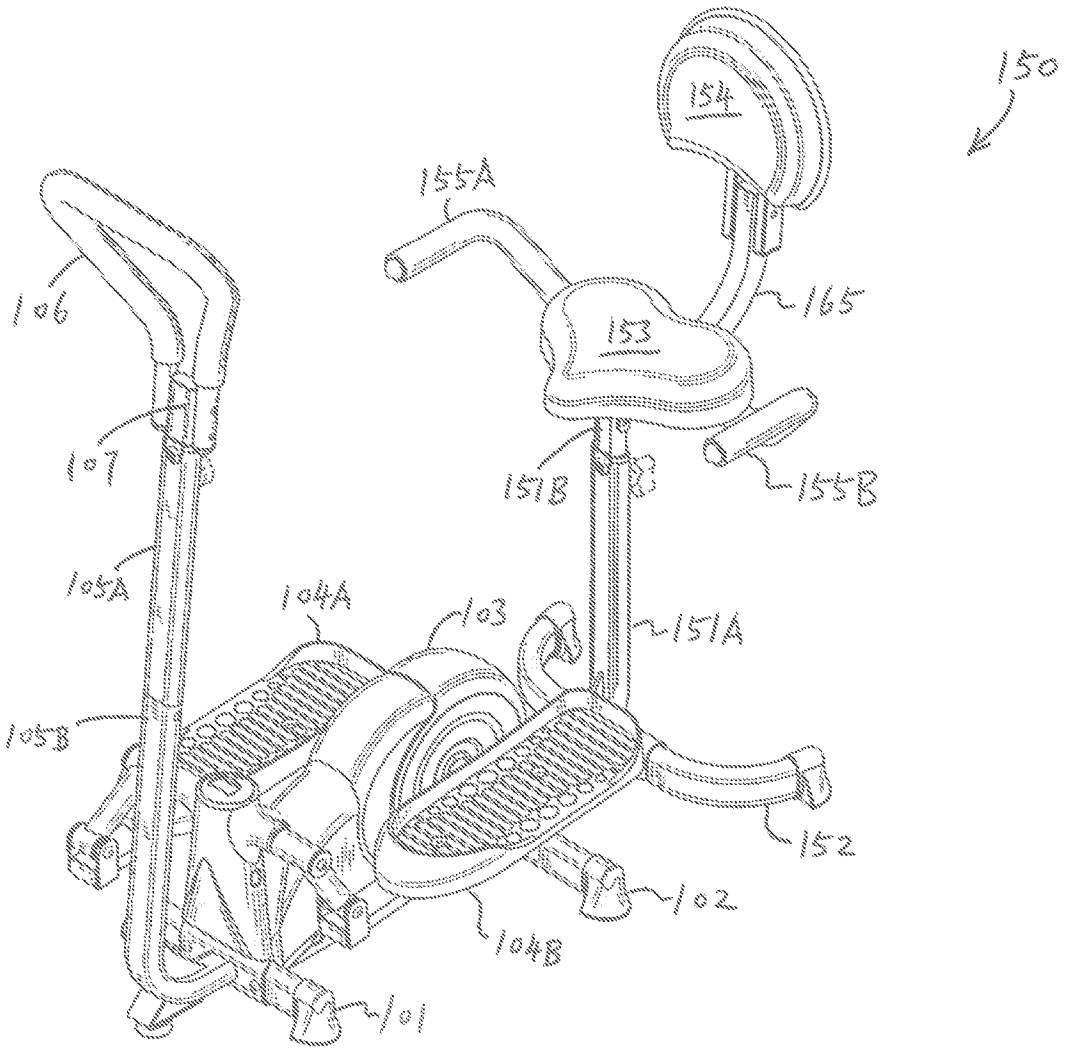
FIG. 6 shows a perspective view of a stepper exercise device according to another embodiment.
Figure 7:
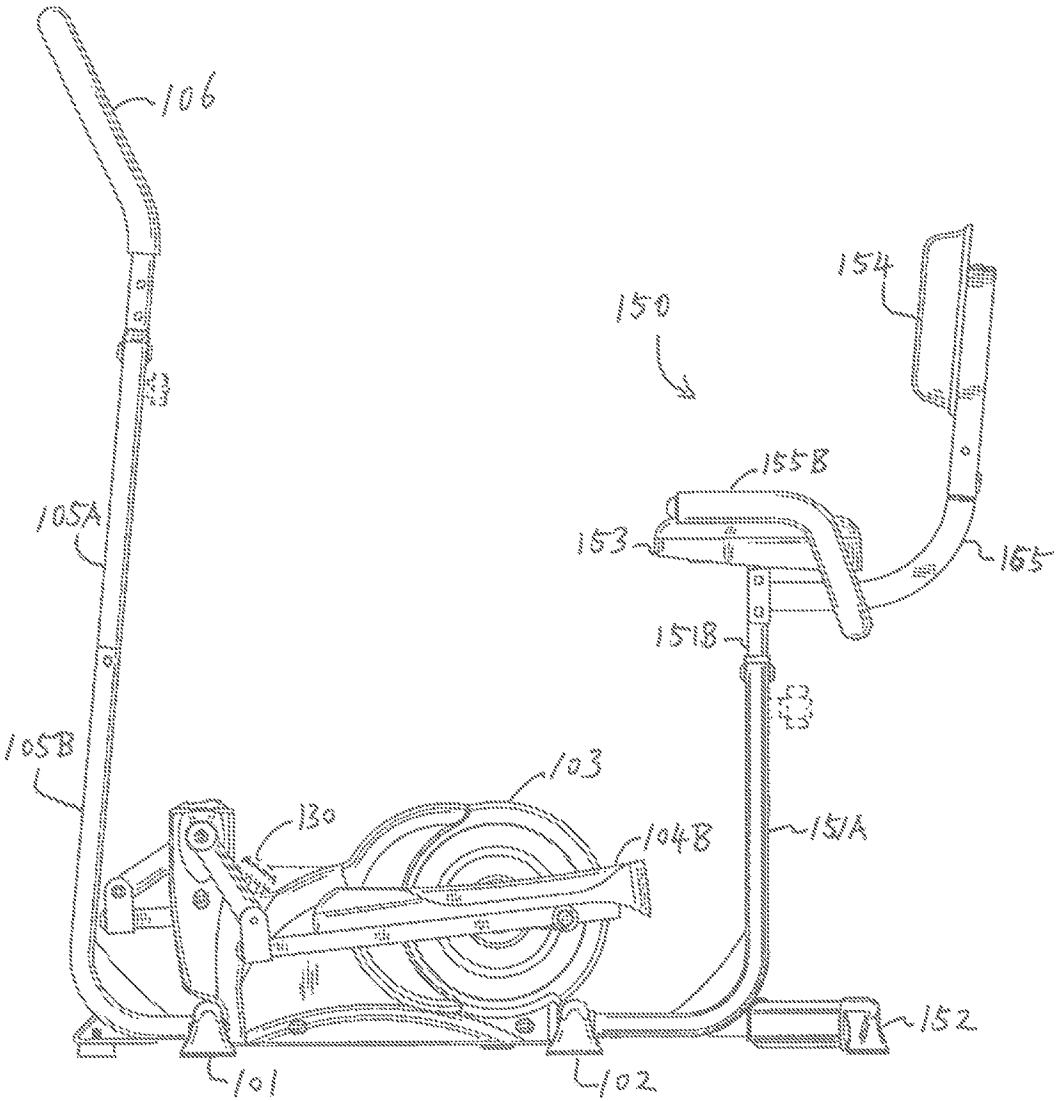
FIG. 7 shows a side view of a stepper exercise device according to another embodiment.

FIG. 6 shows a perspective view and FIG. 7 shows a side view of a stepper exercise device according to another embodiment of the invention. Referring to FIGS. 6-7, in addition to the support posts 105A-105B attached up front, a seating section 150 can also be attached to a backend of the exercise device. Seating section 150 includes a seat support frame having a seat vertical support post having a lower section 151A and an upper section 151B (collectively referred to as support post 151), and a seat support base 152 (also referred to as a seat horizontal support beam). The lower section 151A is a tubular frame to allow the upper section 151B to extend from within the tubular tunnel and to retract into the tubular tunnel from the upper end of vertical support post 151A. The lower end of the vertical support post 151A can be attached to the rear support beam 102 of the base support frame of the exercise device. In one embodiment, the lower section 151A is configured in an L-shape tubular frame.

Figure 8:
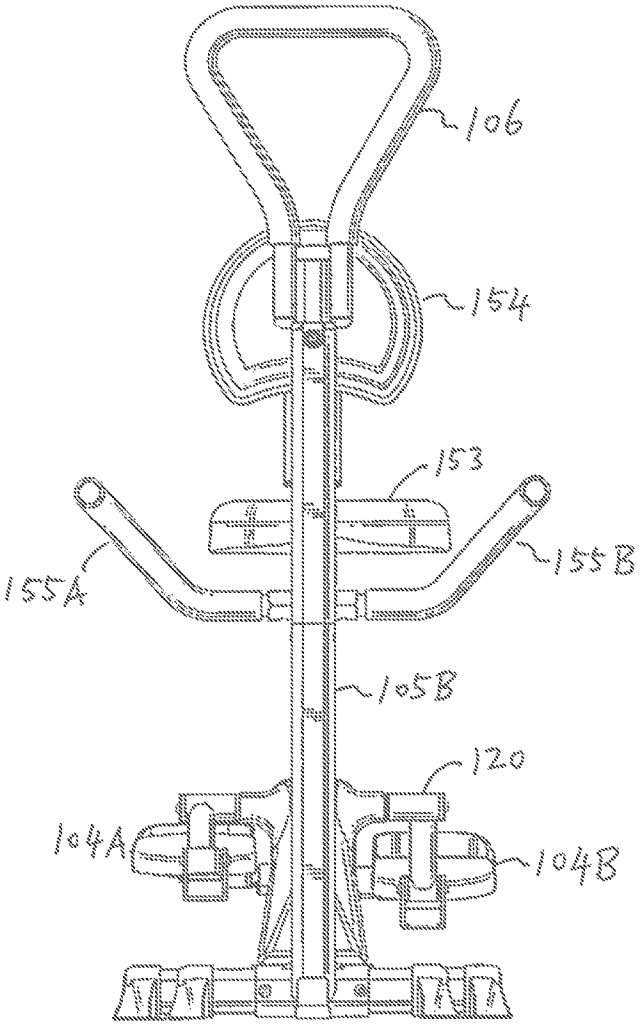
FIG. 8 shows a front view of a stepper exercise device according to one embodiment.
Figure 9:
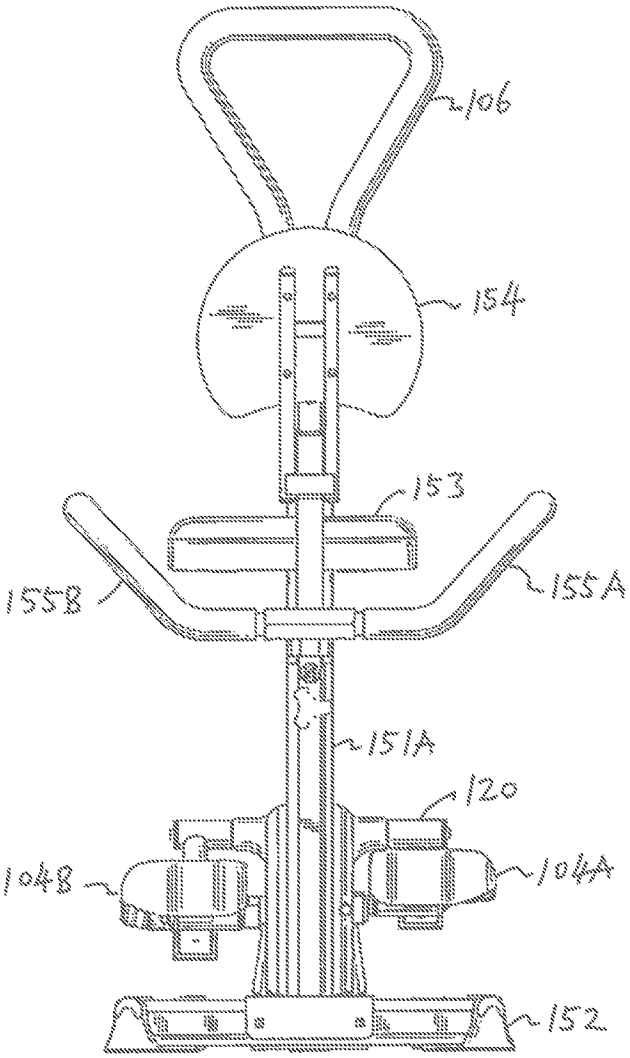
FIG. 9 shows a rear view of a stepper exercise device according to one embodiment.
Figure 10:
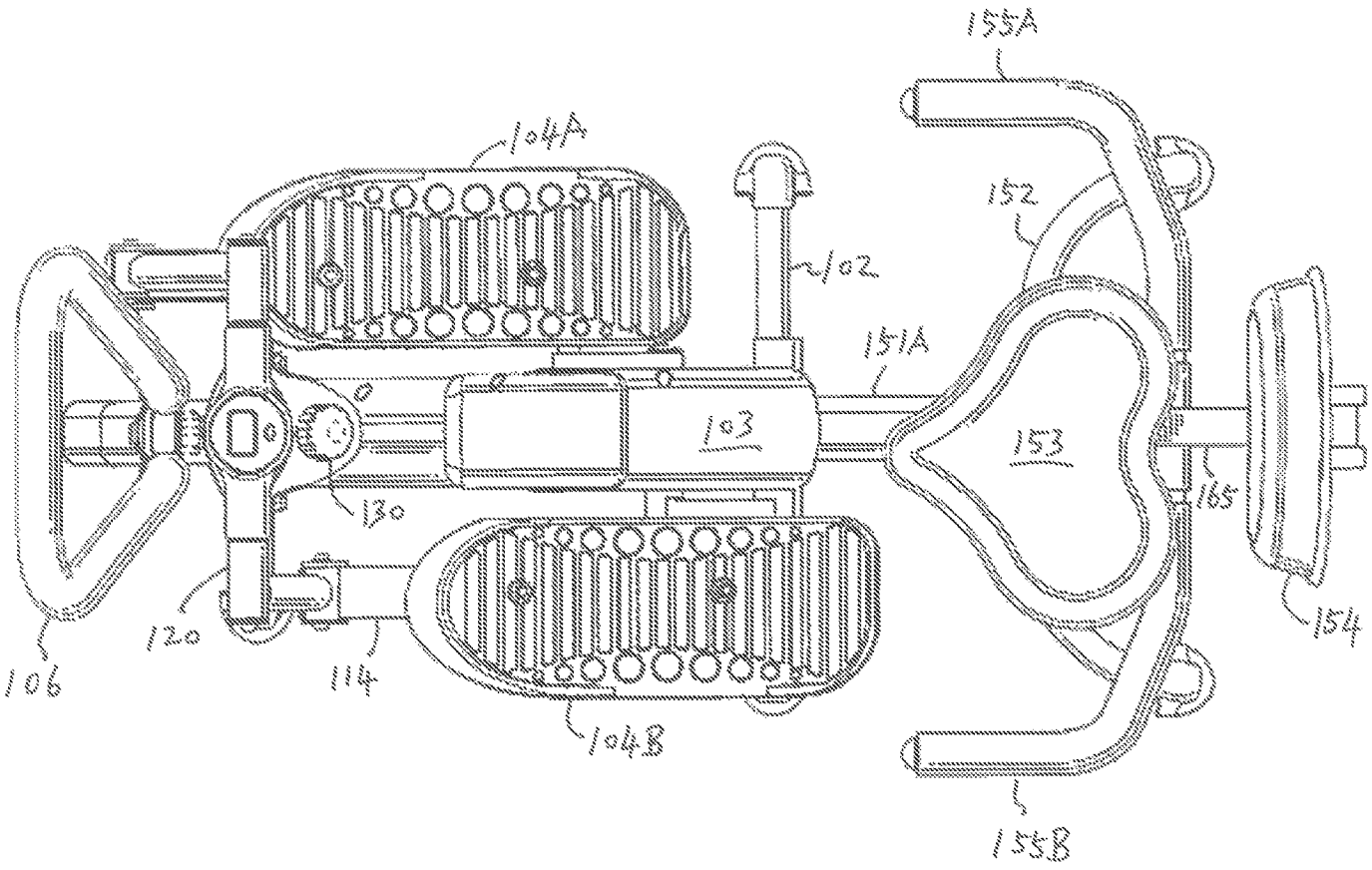
FIG. 10 shows a top view of a stepper exercise device according to one embodiment.
Figure 11:
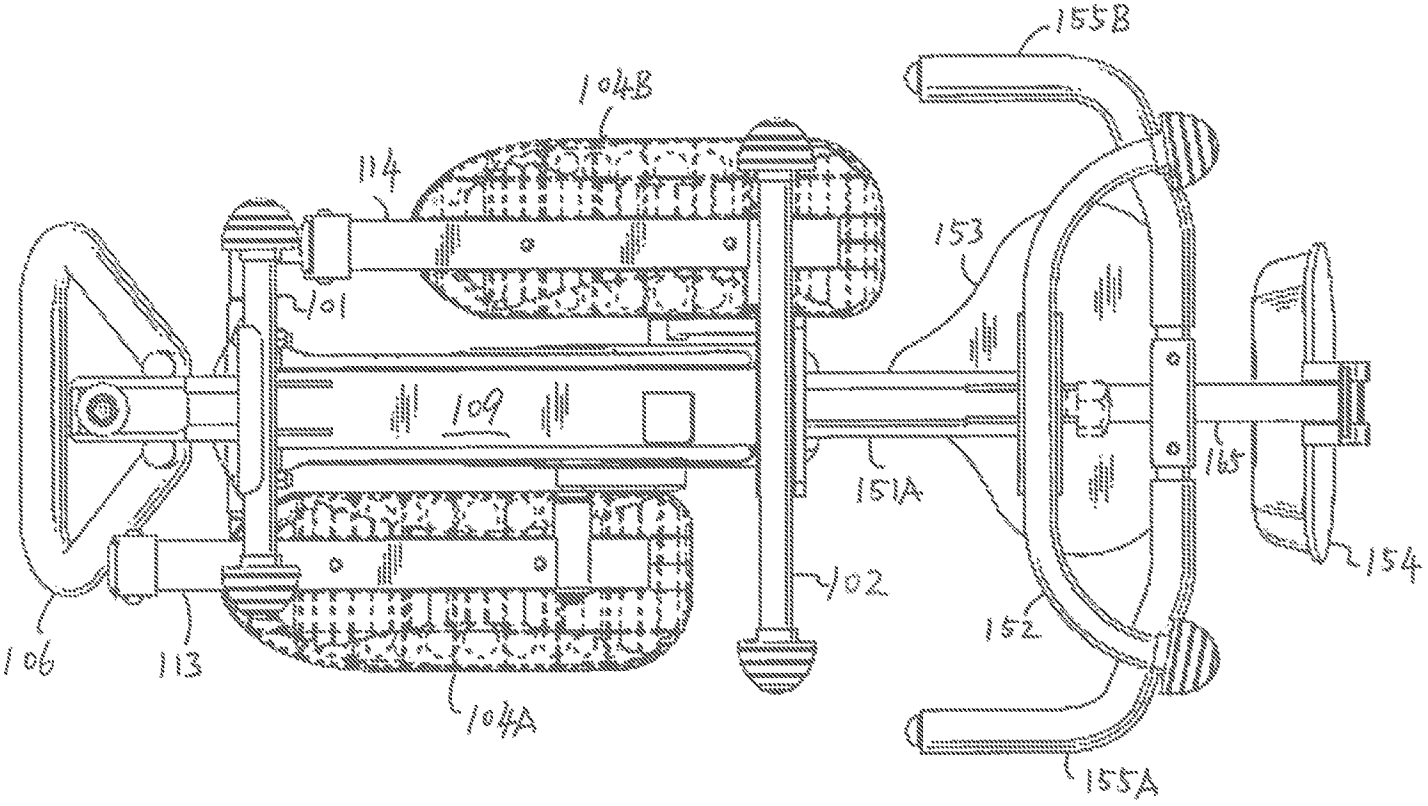
FIG. 11 shows a bottom view of a stepper exercise device according to one embodiment.
Figure 12:
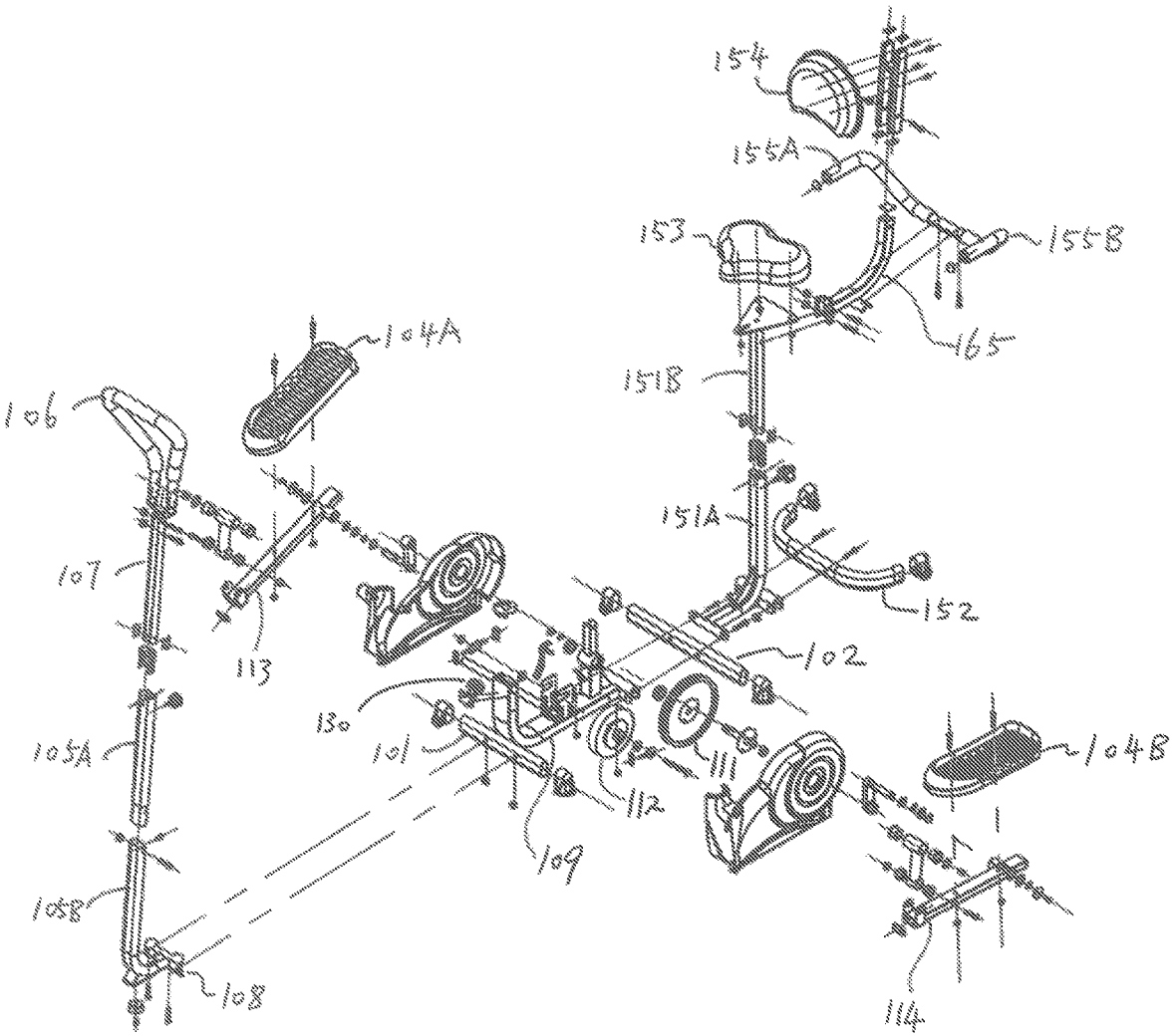
FIG. 12 shows an exploded view of a stepper exercise device according to one embodiment.

In addition, according to one embodiment, seating section 150 further includes a back rest support frame having an L-shape back rest support post 165 having a lower end and an upper end. The lower end of back rest post 165 is coupled to an upper end of the upper section post 151B and the upper end of back rest post 165 is coupled to a back rest 154. A pair of arm rests 155A-155B are extended from the back rest post 165 to allow a user to sit on the seat pad 153, rest user's back on back rest 154, and rest user's arms on arm rests 155A-155B, while placing user's feet on pedals 104 and 105. Note that the seating section 150 and the front support section (e.g., sections 105-107) are optional and they can be individually added onto and removed from the exercise device, and they do not require to operate with each other. FIG. 8 shows a front view of a stepper exercise device according to one embodiment. FIG. 9 shows a rear view of a stepper exercise device according to one embodiment. FIG. 10 shows a top view of a stepper exercise device according to one embodiment. FIG. 11 shows a bottom view of a stepper exercise device according to one embodiment. FIG. 12 shows an exploded view of a stepper exercise device according to one embodiment.

In the foregoing specification, embodiments of the invention have been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. A stepper exercise device, comprising:

a base support frame adapted to be positioned on a support surface;

a wheel assembly mounted on the base support frame, the wheel assembly including a first wheel capable of being rotated;

a stepper assembly coupled to the base support frame and the first wheel of the wheel assembly, the stepper assembly including a first step pedal and a second step pedal coupled to a first side and a second side of the first wheel respectively, wherein the first step pedal and the second step pedal are configured to move in an elliptical motion, wherein when a user stands on and actuates the first and second step pedals, the user's movement resembles a step motion of a person walking on the support surface; and a resistance adjustment mechanism coupled to the wheel assembly, wherein the adjustment mechanism is configured to provide different amounts of resistance to rotational motions of the first wheel, which in turn provides various resistance to step motions of the first and second step pedals to adjust intensity of exercise of the user, wherein the wheel assembly further comprises a second wheel coupled to the first wheel, wherein the second wheel operates as a resistant load to the first wheel, wherein the resistance adjustment mechanism is configured to adjust a resistance of the second wheel, which in turn adjusts a resistance of the first wheel wherein the resistance adjustment mechanism further comprises a braking device to provide different amounts of friction to an exterior surface of the second wheel, wherein the braking device comprises a brake pad capable of being applied to the exterior surface of the second wheel, wherein the which in turns transforms various resistance to the second wheel, and wherein the resistance adjustment mechanism further comprises: a rotational knob mounted on the base support frame; and a wire coupled to the rotational knob and the braking device, wherein when the rotational knob is rotated, the wire is pulled to cause the braking device to push the brake pad against the exterior surface of the second wheel, which in turn increases the friction between the brake pad and the exterior surface of the second wheel.

2. The exercise device of claim 1, wherein the first wheel and the second wheel are coupled to each other via a transmission belt.

3. The exercise device of claim 1, further comprising a tubing device enclosing the wire therein, the tubing device having a first end coupled to the rotational knob and a second end coupled to the braking device, wherein when the rotational knob rotates in a first direction, the wire is pulled out of the tubing device, which in turn causes the brake pad being pushed against the exterior surface of the second wheel.

4. The exercise device of claim 3, wherein when the rotational knob rotates in a second direction, the wire is retracted into the tubing device, which in turn releases the brake pad from the exterior surface of the second wheel.

5. The exercise device of claim 3, wherein the braking device further comprises:

a brake holding plate having a first section and a second section jointed together in an angle to form a joint section, wherein the brake pad is disposed on a far end of the first section and the wire is coupled to a far end of the second section; and a support rod to provide a support to the joint section of the brake holding plate to allow the brake holding plate to tilt with respect to the support rod, wherein when the wire is pulled towards the rotational knob, the far end of the second section is pulled to cause the far end of the first section to be tilted with respect to the support rod, which pushes the brake pad against the exterior surface of the second wheel.

6. The exercise device of claim 5, wherein the braking device further comprises:

a brake mounting bracket mounted on the base support frame, the brake mounting bracket having the support road attached thereon; and a stop plate disposed on the brake mounting bracket, where in the stop plate includes a hole large enough to allow the wire to go through to be connected to the far end of the second section of the brake holding plate while the hole is small enough to prevent the tubing device from going through.

7. The exercise device of claim 6, wherein the braking device further comprises a spring surrounding the wire between the stop plate and the far end of the second section of the brake holding plate, wherein when the wire is pulled by rotating the rotational knob, the wire causes the far end of the second section of the brake holding plate to tilt in a first direction with respect to the support rod, which compresses the spring that in turn pushes the brake pad against the exterior surface of the second wheel.

8. The exercise device of claim 7, wherein when the wire is released by rotating the rotational knob, the spring expands to push the far end of the second section of the brake holding plate to tilt in a second direction with respect to the support rod, which in turn releases the brake pad from applying pressure on the exterior surface of the second wheel.

9. The exercise device of claim 1, wherein the base support frame comprises:

a front beam;

a rear beam disposed relatively in parallel with the front beam; and a center support base coupled to the front beam and the rear beam, wherein the wheel assembly is mounted on the center support base.

10. The exercise device of claim 9, wherein the center support base comprises a first longitude section and a second longitude section forming an L-shape support base, wherein the first longitude section is coupled to the front beam and the rear beam horizontally, while the second longitude section extends upwardly, and wherein the rotational knob is mounted on the second longitude section.

11. The exercise device of claim 10, wherein the stepper assembly further comprises:

a first step support plate having the first step pedal attached thereon; and a second step support plate having the second step pedal attached thereon, wherein each of the first and second step support plates are coupled to the first wheel and the second longitude section of the L-shape support base.

12. The exercise device of claim 11, wherein each of the first and second step support plates comprises:

a first end coupled to the first wheel via a first connection bar coupled to a center of the first wheel; and a second end coupled to the second longitude section of the L-shape support base via a connection bar to allow the first and second step pedals to perform an elliptical motion while the first wheel rotates.

* * * * *